US007614170B2

(12) United States Patent
Kwon

(10) Patent No.: US 7,614,170 B2
(45) Date of Patent: Nov. 10, 2009

(54) EXTENDABLE EXCAVATING SCREW UNIT EQUIPPED WITH HYDRAULIC EXCAVATING AUXILIARY BLADES

(75) Inventor: Sae Won Kwon, Goesan-Gun (KR)

(73) Assignee: Daewon Electric Co. Ltd., Choongchungbuk-Do (KR)

( * ) Notice: Subject to any disclaimer, the term of this patent is extended or adjusted under 35 U.S.C. 154(b) by 0 days.

(21) Appl. No.: 12/071,535

(22) Filed: Feb. 22, 2008

(65) Prior Publication Data

US 2008/0295363 A1 Dec. 4, 2008

(30) Foreign Application Priority Data

May 28, 2007 (KR) ..... 10-2007-0051211

(51) Int. Cl.
*E02F 3/24* (2006.01)
*E21B 10/44* (2006.01)

(52) U.S. Cl. ..... 37/189; 37/352; 175/395; 173/150

(58) Field of Classification Search ..... 37/189, 37/352, 364; 175/394, 56, 323, 395; 173/145, 173/150, 148

See application file for complete search history.

(56) References Cited

U.S. PATENT DOCUMENTS 1,932,239 A * 10/1933 Berry ..... 408/67
2,598,203 A * 5/1952 Acker, Jr. ..... 173/150
2,694,551 A * 11/1954 Snyder ..... 175/56
2,847,188 A * 8/1958 Wiltse ..... 173/150
3,219,131 A * 11/1965 Boyd ..... 175/92
3,241,624 A * 3/1966 Rassieur ..... 175/257
3,519,088 A * 7/1970 Bayless ..... 173/149
3,565,190 A * 2/1971 Ishii ..... 175/171
3,565,351 A * 2/1971 Ross et al. ..... 241/99
3,572,449 A * 3/1971 Brocas et al. ..... 175/57
3,794,127 A * 2/1974 Davis ..... 175/58
3,957,125 A * 5/1976 Russell, Jr. ..... 173/150
4,016,944 A * 4/1977 Wohlfeld ..... 175/92
4,061,197 A * 12/1977 Skidmore, Jr. ..... 175/101
4,098,012 A * 7/1978 Parrish ..... 37/351

(Continued)

FOREIGN PATENT DOCUMENTS

JP 61083718 A * 4/1986

(Continued)

*Primary Examiner*—Thomas A Beach
(74) *Attorney, Agent, or Firm*—GWiPS

(57) ABSTRACT

An excavating screw unit equipped with a hydraulic excavating auxiliary blades has developed for an auger crane, comprising: an extension unit having auxiliary excavating blade, cylinder mounting hole, built-in fluid passages in extension unit, hydraulic cylinder, piston, and extension guiding rods; an excavation column formed a hollow center of a square-shaped to mount on top of extension unit; an extension rod having an outer square-shape to fit into the excavation column, a built-in hydraulic passages in the extension rod, at top portion of the extension rod, an inlet and outlet that is bent right angle at top portion of the hydraulic passages to connect to hydraulic tubes, the extension rod is sliding to extend or retract through the excavation column. The extended excavating auxiliary blades are maintained by the pressurized fluid to prevent retracting by digging resistance during the excavating. Thus, this mechanized excavating device is easily digging a burial hole for a utility pole and underbracing.

2 Claims, 9 Drawing Sheets

U.S. PATENT DOCUMENTS 4,253,531 A * 3/1981 Boros ..... 175/56
4,474,252 A * 10/1984 Thompson ..... 175/69
4,958,690 A * 9/1990 Cyphelly ..... 175/296
5,156,223 A * 10/1992 Hipp ..... 175/296
5,305,837 A * 4/1994 Johns et al. ..... 175/61
5,427,190 A * 6/1995 Mo ..... 175/205
5,517,774 A * 5/1996 Rogers ..... 37/189
5,568,838 A * 10/1996 Struthers et al. ..... 175/246
6,571,492 B2 * 6/2003 Greenwood ..... 37/348
6,978,849 B2 * 12/2005 Sherwood ..... 175/57
2008/0179101 A1 * 7/2008 Mash ..... 175/325.1

FOREIGN PATENT DOCUMENTS

JP 03107090 A * 5/1991
JP 06323078 A * 11/1994

* cited by examiner

EXTENDABLE EXCAVATING SCREW UNIT EQUIPPED WITH HYDRAULIC EXCAVATING AUXILIARY BLADES

BACKGROUND OF THE INVENTION

1. Field of the Invention

The present invention relates to a mechanized excavating device for mounting on an auger crane to prepare a burial hole for utility pole and underbracing, and more specifically the hydraulic excavating auxiliary blades mounted at lower end of an extendable excavating screw unit is extendable and retractable by hydraulic pressure.

2. Description of the Related Art

Generally in the construction of power transmission and distribution lines and communication lines, utility poles are erected and electric and communication cables are installed on the poles. In this case, to respond the unbalanced tension of the electric and communication cables, a utility pole underbracing or guy wire is installed to prevent the utility pole from inclining or falling down. The utility pole underbracing is buried simultaneously with the utility pole after erecting the utility pole and excavating 0.5 m below the ground surface of the lower end of the utility pole. Next, to install the guy wire, excavation work for burial of the guy wire underbracing is carried out using man power or a machine. After that, guy wire underbracing is buried at the excavation point to be connected with the utility pole.

Normally, excavation work for installing such a utility pole underbracing or guy wire underbracing is done using an excavating screw fastened to an auger crane. Meanwhile, techniques for more achieving better quality and more efficient mechanized works are disclosed in prior art. For example, in Korean Patent Application No. 2005-126562 filed by the applicant of the present invention, as well as in Korean Utility Model Registration No. 0417120 and Korean Patent Application No. 2006-122020 are disclosed excavating screws for auger cranes having various types of retractable auxiliary blades.

However, because the excavating screws disclosed in these documents have a mechanism by which the auxiliary excavating blade is extended and retracted by manual rotation, many problems arise such as needing many workers, the difficulty of adjusting the auxiliary excavating blades, and the work time consumed to perform the adjustments.

So, an excavating screw in which auxiliary excavating blades of a type similar to the aforementioned are extended and retracted by hydraulic pressure is disclosed in Japanese Patent Laid-Open No. H13-73664. Since it is possible to remotely control the auxiliary excavating blades using hydraulic pressure in this excavating screw, it can be used economically and effectively. However, since the fluid transmission system is complicated in the auxiliary excavating blades having a hydraulic retracting means, actual application is difficult.

Meanwhile, both the excavating screw developed by the applicant of the present invention and the excavating screw with hydraulically extended and retracted auxiliary excavating blades can only be used for excavations of limited depth. Therefore, in the case of working on excavations deeper than the length of the excavating screw, an extendable excavating screw having an extension means should be used instead of the aforementioned excavating screw.

In an extendable excavating screw, an extension rod that can be inserted into and out of the excavating screw is inserted into the excavating screw. Since the total length of the excavating screw is varied according to the drawn-out length of the extension rod, excavation work is possible to deeper depths. Accordingly, if auxiliary excavating blades having a conventional rotation-type extending and retracting means are applied to an extendable excavating screw, operation is still difficult and cumbersome.

Therefore, the excavating screw used for deep excavation keenly requires auxiliary excavating blades and a hydraulic extending and retracting means to make more economic excavation possible.

SUMMARY OF THE INVENTION

It is an object of the present invention to provide an extendable excavating screw with hydraulic auxiliary excavation blades, wherein oil inflow and discharge passages (also referred to as fluid channels) are formed in an extension rod that is inserted into and out of the inside of the excavating screw, and separate auxiliary oil inflow and discharge passages are formed in the extension unit that is mounted on the bottom of the excavating screw, to apply hydraulic pressure continuously to the auxiliary excavating blades mounted on the lower extension unit even if the length of the extendable excavating screw is varied, so that the hydraulically operated auxiliary excavating blades can be used while varying the length of the excavating screw according to the required depth of the excavation and the work period is shortened and workability is improved.

In accordance with the present invention, there is provided an extendable excavating screw with hydraulic auxiliary excavating blades which has a tube-shaped excavation pipe, an extension unit that is combined with the lower end of the excavation pipe and has auxiliary excavating blades, a spiral screw placed on the outer circumference of the excavation pipe and extension unit, an extension rod installed in the excavation pipe such that it may extend or retract, and a coupler mounted at the upper end of the extension rod for attaching to an auger crane, the extendable excavating screw characterized in that: said coupler comprises an oil hose in which oil pumped from a fluid system flows in; said extension rod comprises an oil inflow passage for oil to flow in through said oil hose and an oil discharge passage for oil to be discharged through said oil hose; said extension unit comprises cylinder slots formed transversely at different heights; an actuating shaft which is mounted and able to slide in said cylinder slots in a transverse direction and at one end of which are fixed auxiliary excavating blades; main channels are formed in the extension unit for the oil flowing in and discharged through said oil inflow and discharge passages to flow; and oil pipes, one end of each of which is connected to said oil inflow and discharge passages and the other end of each of which is connected to the main channels through a fluid communication means, are placed between said extension unit and said extension rod inside the excavation pipe, and said oil pipes slide in said oil inflow and discharge passages in unison with the extension rod that is inserted into and out of the excavation pipe, so as to continuously apply hydraulic pressure on the actuating shaft having said auxiliary excavating blades through said main channels.

DETAILED DESCRIPTION OF THE PREFERRED EMBODIMENT

Hereinafter, an extendable excavating screw with hydraulic auxiliary excavating blades of the present invention will be described in detail with reference to the accompanying drawings.

Figure 1:
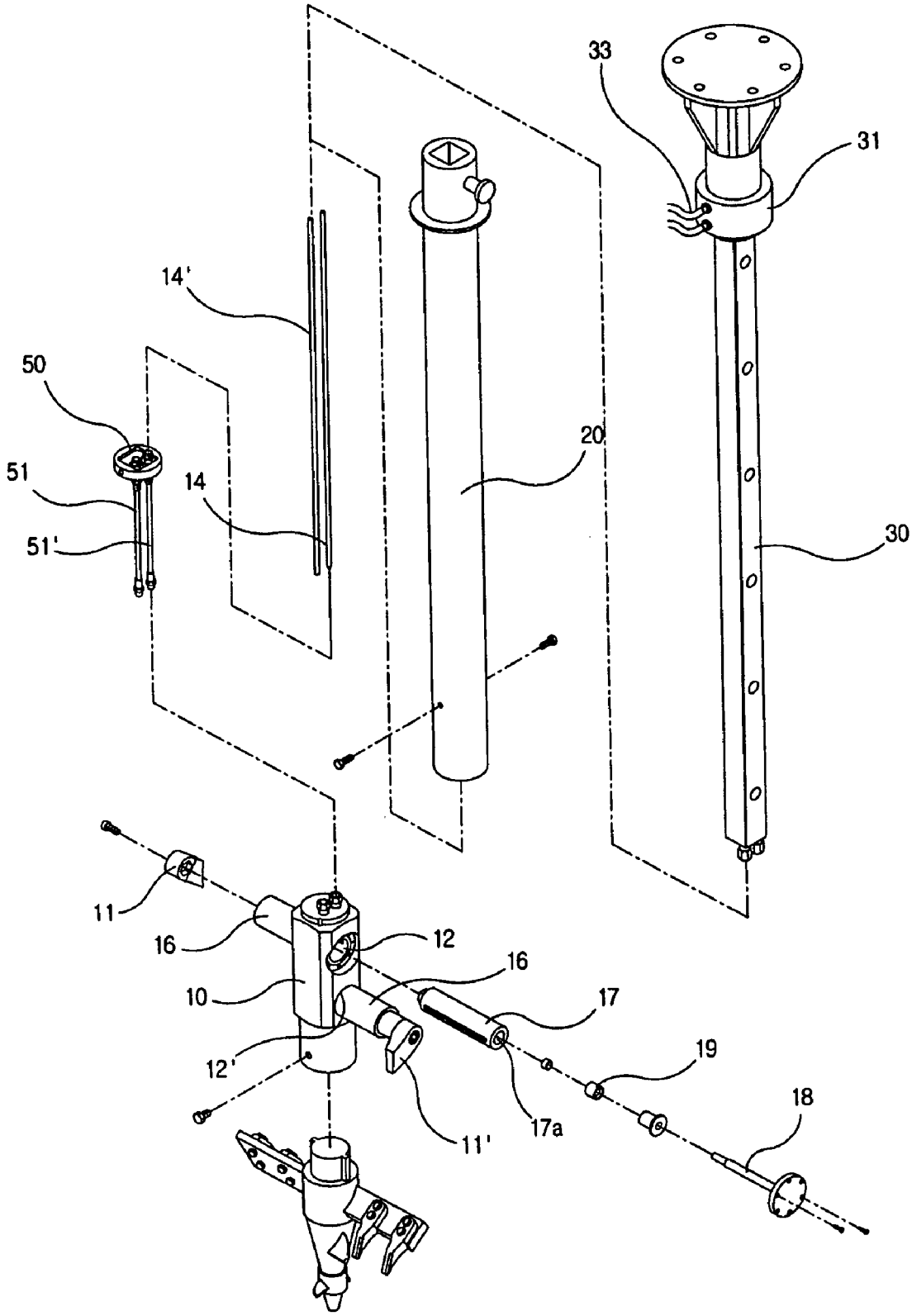
FIG. 1 is an exploded perspective view of an excavating screw according to the present invention.
Figure 2:
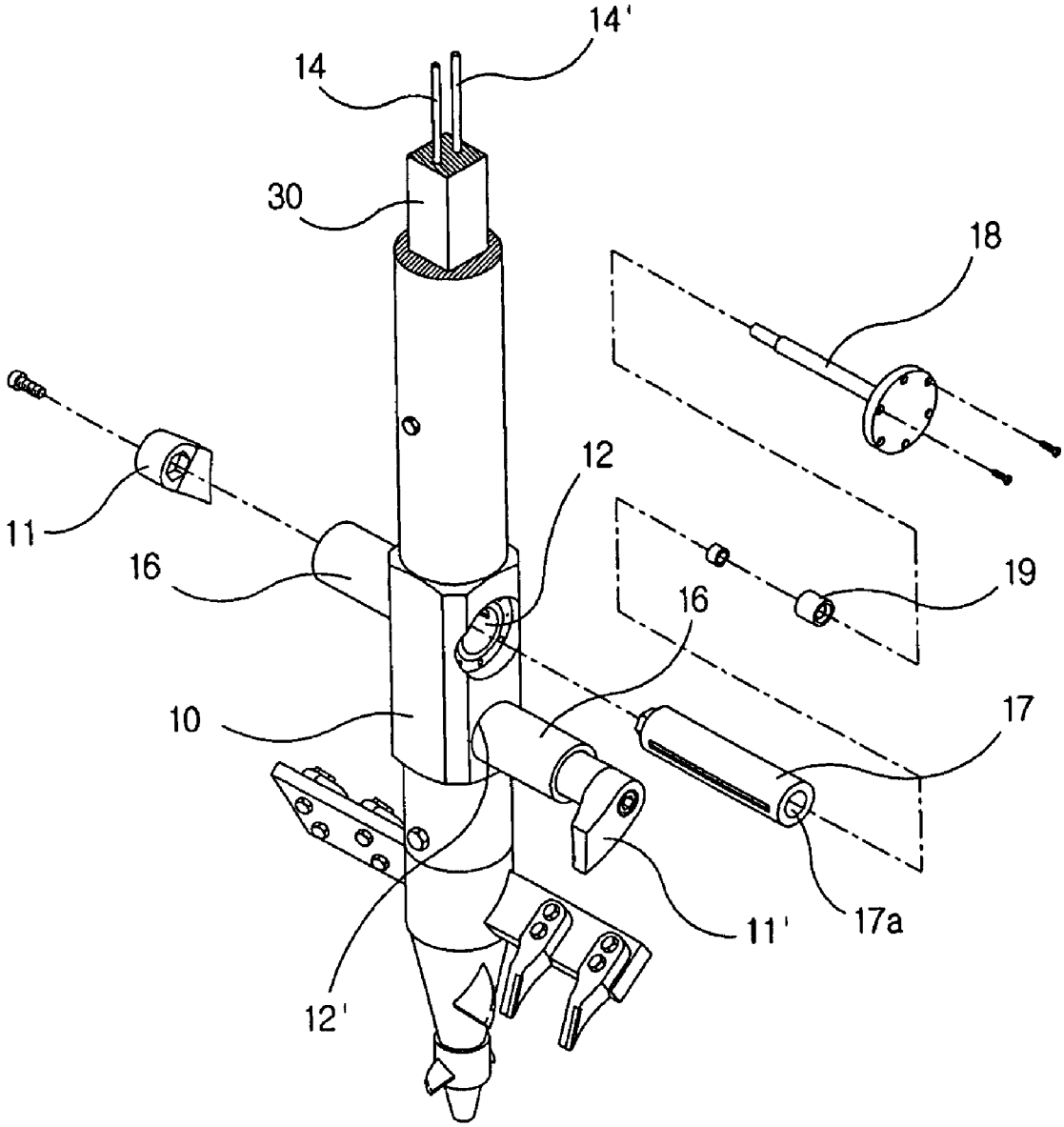
FIG. 2 is an enlarged and exploded perspective view showing the major part of the excavating screw according to the present invention.
Figure 3:
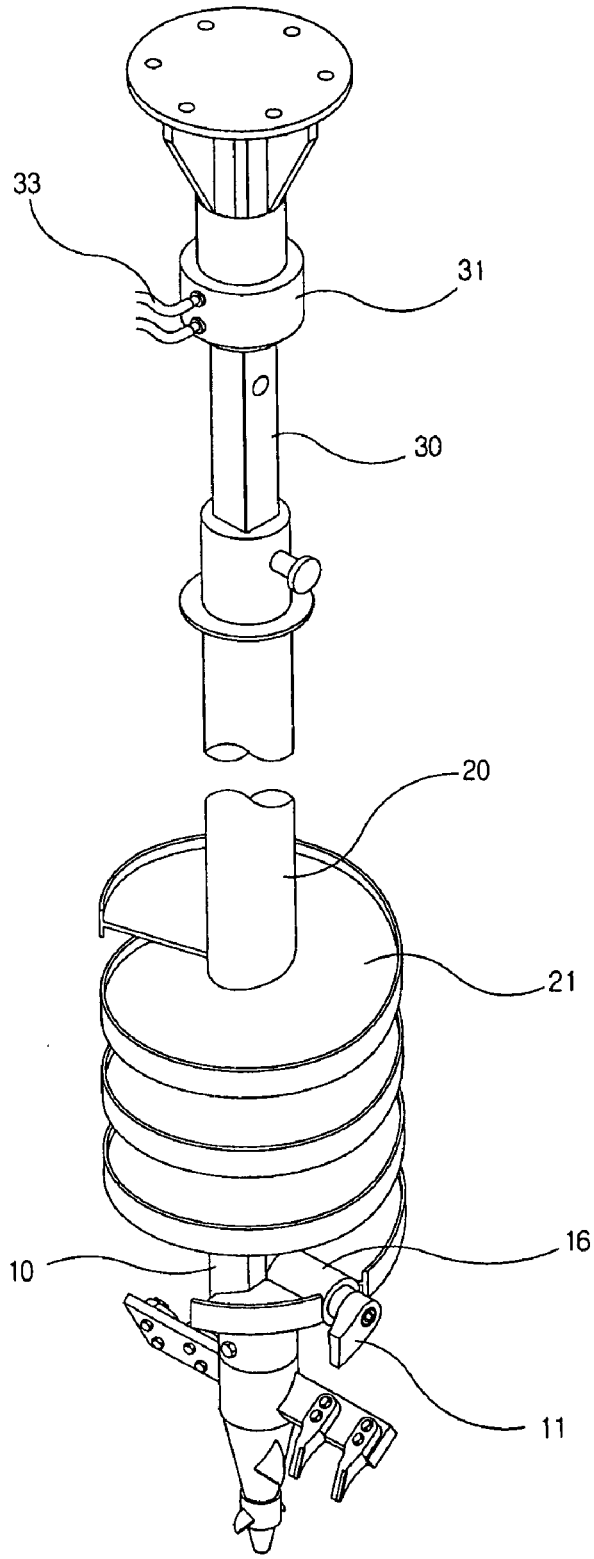
FIG. 3 is a perspective view showing the assembly of the whole excavating screw according to the present invention.
Figure 4:
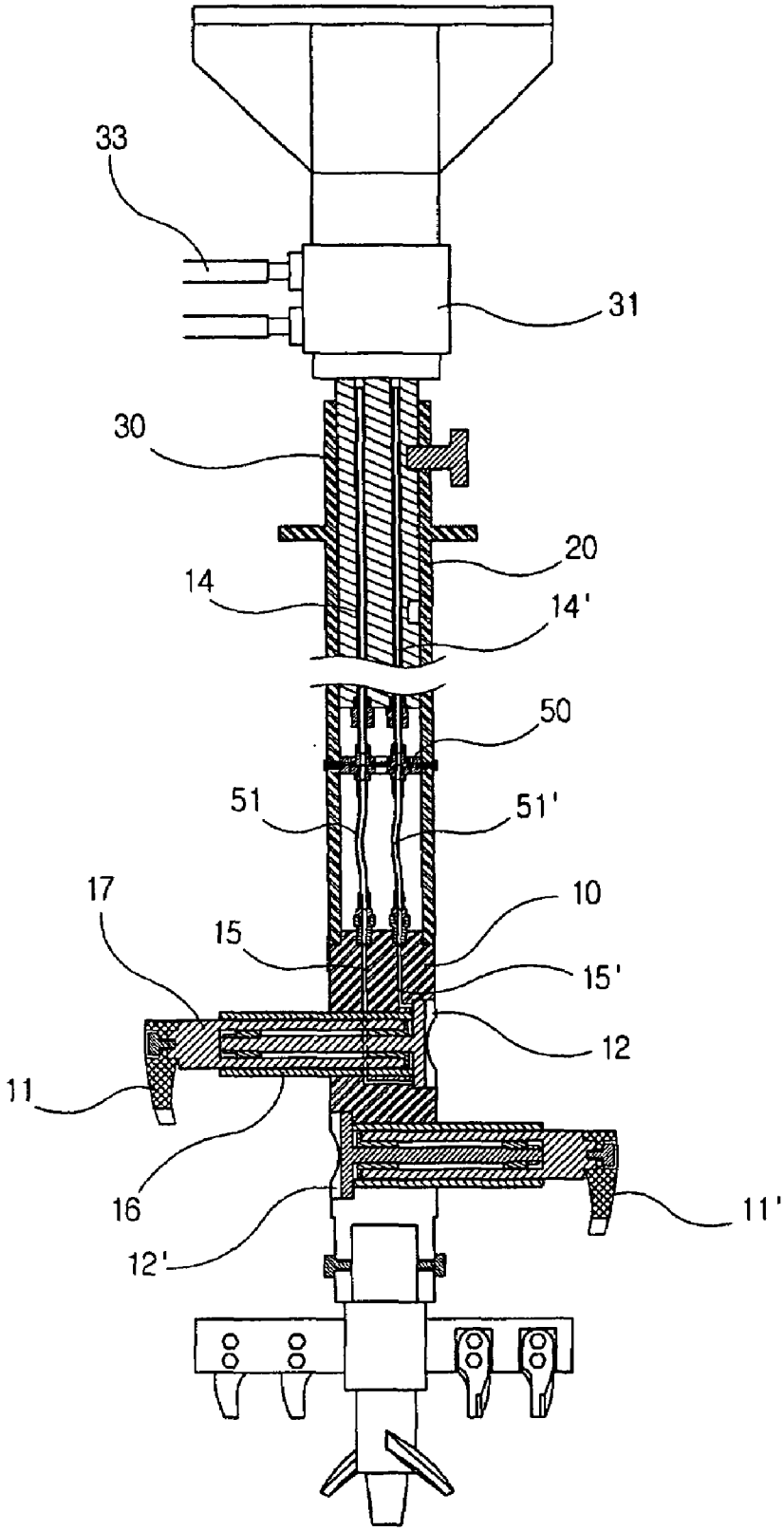
FIG. 4 is a sectional view showing the assembly of the whole excavating screw according to the present invention.

FIG. 1 is an exploded perspective view of an excavating screw according to the present invention, FIG. 2 is an enlarged and exploded perspective view showing the major part of the excavating screw according to the present invention, FIG. 3 is a perspective view showing the assembly of the whole excavating screw according to the present invention, and FIG. 4 is a sectional view showing the assembly of the whole excavating screw according to the present invention.

An extendable excavating screw unit having hydraulic auxiliary blades of the present invention comprises a tube-shaped excavation column (20), an extension unit (10) that is attached to the lower end of the excavation column (20) has auxiliary excavating blades (11, 11'), a spiral screw (21), an extension rod (30) extended and installed inside the excavation column (20), and a boss (31) formed at the top end of the extension rod (30) for attaching to an auger crane.

The boss (31) has connected to the hydraulic hose (33) to supply pressurized oil pumped from a fluid system. The extension rod (30) comprises an oil inlet (32) for oil inflow through the hydraulic hose (33), and an oil outlet (32') for oil discharge through the hydraulic hose (33).

The extension unit (10) comprises a pair of the cylinder mounting holes (12, 12') in parallel to each other at different position, but perpendicular to the axis of the extension unit (10). A set of the cylinder (16) and piston (17) are mounted in the cylinder mounting holes (12, 12') oriented opposite direction and auxiliary excavating blades (11, 11') are fixed at one end thereof. A pair of the built-in fluid passages (15, 15') is formed inside the extension unit (10) for oil supplying and discharging through the built-in hydraulic tube (14, 14'). The other ends of the built-in fluid passages (15, 15') are connected to the cylinders (16) and pistons (17).

An excavation column (20) has a square-shape hollow center, and a bottom end of the excavation column (20) mounted on top of the extension unit (10).

An extension rod (30) has an outer square-shape to fit into the excavation column (20), and a pair of built-in hydraulic tube (14, 14') formed in the extension rod (30). The top portion of the hydraulic passages in the extension rod (30) has bent right angle to form an inlet and outlet (32, 32') for connecting to hydraulic hose (33). The extension rod (30) is inserted into the excavation column (20) for extending or retracting. The oil inlet and outlet (32, 32') is connected to the other end of the hydraulic tube (14, 14') formed in the extension rod (30). A pair of the flexible hydraulic hoses (51, 51') is connected to built-in fluid passages (15, 15') in the extension unit (10) through the hydraulic tube (14, 14') formed in the extension rod (30) and the oil inlet and outlet (32, 32').

When the extension rod (30) moves to slide along with the excavation column (20), the flexible hydraulic hoses (51, 51') are expending or contracting in unison. So that the hydraulic pressure is continuously supplied through the oil inlet and outlet (32, 32') to the built-in hydraulic tube (14, 14') in the extension rod (30) and the built-in fluid passages (15, 15') extension unit (10) to the piston (17) being attached the auxiliary excavating blades (11, 11').

Also, the extendable excavating screw unit of the present invention further comprises a mounting plate (50) disposed in the excavation column (20) for mounting the flexible hydraulic hoses (51, 51'). The built-in hydraulic tube (14, 14') in the extension rod (30) is connected to the flexible hydraulic hoses (51, 51'), which is fixed on the mounting plate (50) and the other end of the hydraulic hoses (51, 51') connected to communicate with the built-in fluid passages (15, 15') of the extension unit (10).

Therefore, when the excavation column (20) begins to rotate, the extension unit (10) will be twisted relative to the rotation. Then, the flexible hydraulic hoses (51, 51') will offset the relative twist to prevent the damage on the built-in hydraulic tube (14, 14') in the excavation column (20).

Figure 7:
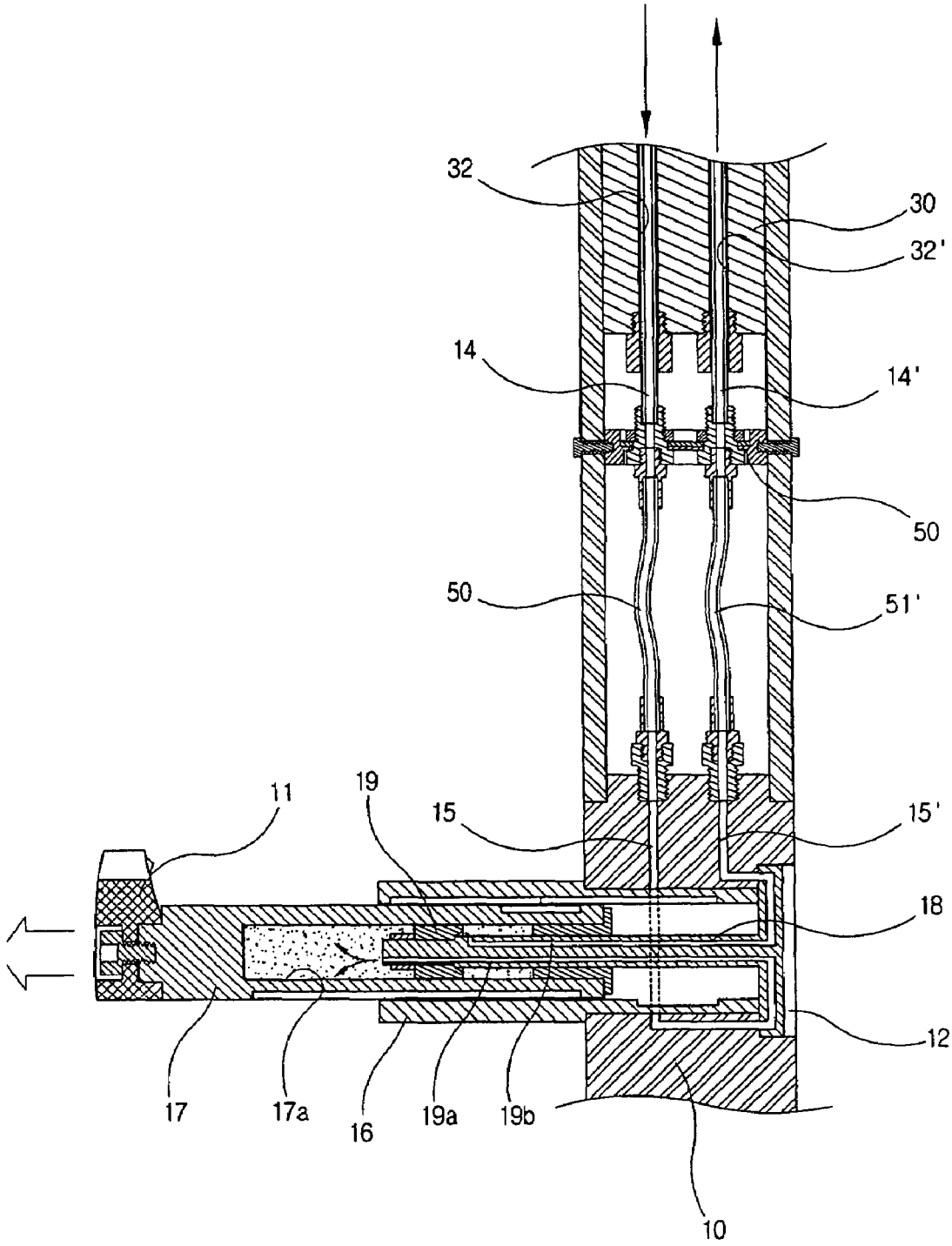
FIG. 7 is a sectional view showing the state in which the auxiliary excavating blades of the excavating screw according to the present invention are extended by hydraulic pressure.

At this time, as shown in the enlargement in FIG. 7, the ends of the built-in hydraulic tube (14, 14') and flexible hydraulic hoses (51, 51') are sealed and assembled by the retainers. At the lower end of the extension rod (30), the retainers are also installed to prevent oil leaking while the built-in hydraulic tube (14, 14') are sliding along the oil passages in the extension rod (30). The built-in hydraulic tube (14, 14') is sliding smoothly.

In the cylinder mounting holes (12, 12') of the extension unit (10), the cylinder (16) is mounted for supporting the piston (17) attached the auxiliary excavating blades (11, 11') at its ends. One end of the cylinder (16) is inserted to mount on the cylinder mounting holes (12, 12') and the other end is protruded from one side of the extension unit (10). The pistons (17) are inserted into the cylinder (16) through the opposite end of the installed cylinder (16). A fluid chamber (17*a*) is formed at the center of the pistons (17) for installing a piston shaft (18). An end flange integrally formed with the piston shaft (18) is fixed to the end of the cylinder mounting holes (12, 12') of the extension unit (10), and the piston shaft extended from the end flange to be inserted into the fluid chamber (17*a*). At the end portion of the piston shaft (18), a piston ring (19) is installed for slide-contacting with the inner wall of the fluid chamber (17*a*) of the piston. At a tip of the piston shaft (18), a bushing-retainer is installed in front of the piston ring (19) to prevent oil leakage.

The fluid chamber (17*a*) formed in the piston (17) is partitioned into two regions by the piston ring (19). The piston shafts (18) have formed the built-in fluid passages (19*a*, 19*b*) in the piston shafts (18). One end of the built-in fluid passages (19*a*, 19*b*) in the piston shafts (18) communicates with the built-in fluid passages (15, 15') of the extension unit (10). The other ends of the built-in fluid passages (19*a*, 19*b*) are exposed to the fluid chamber (17*a*) divided by the piston ring (19). Thus, the pressurized oil supplied into the fluid chamber (17*a*) is activated the pistons (17). Accordingly, the length of the piston (17) is extended or retracted by the oil supply or discharge into the fluid chambers (17*a*) partitioned by the piston ring (19).

Figure 9:
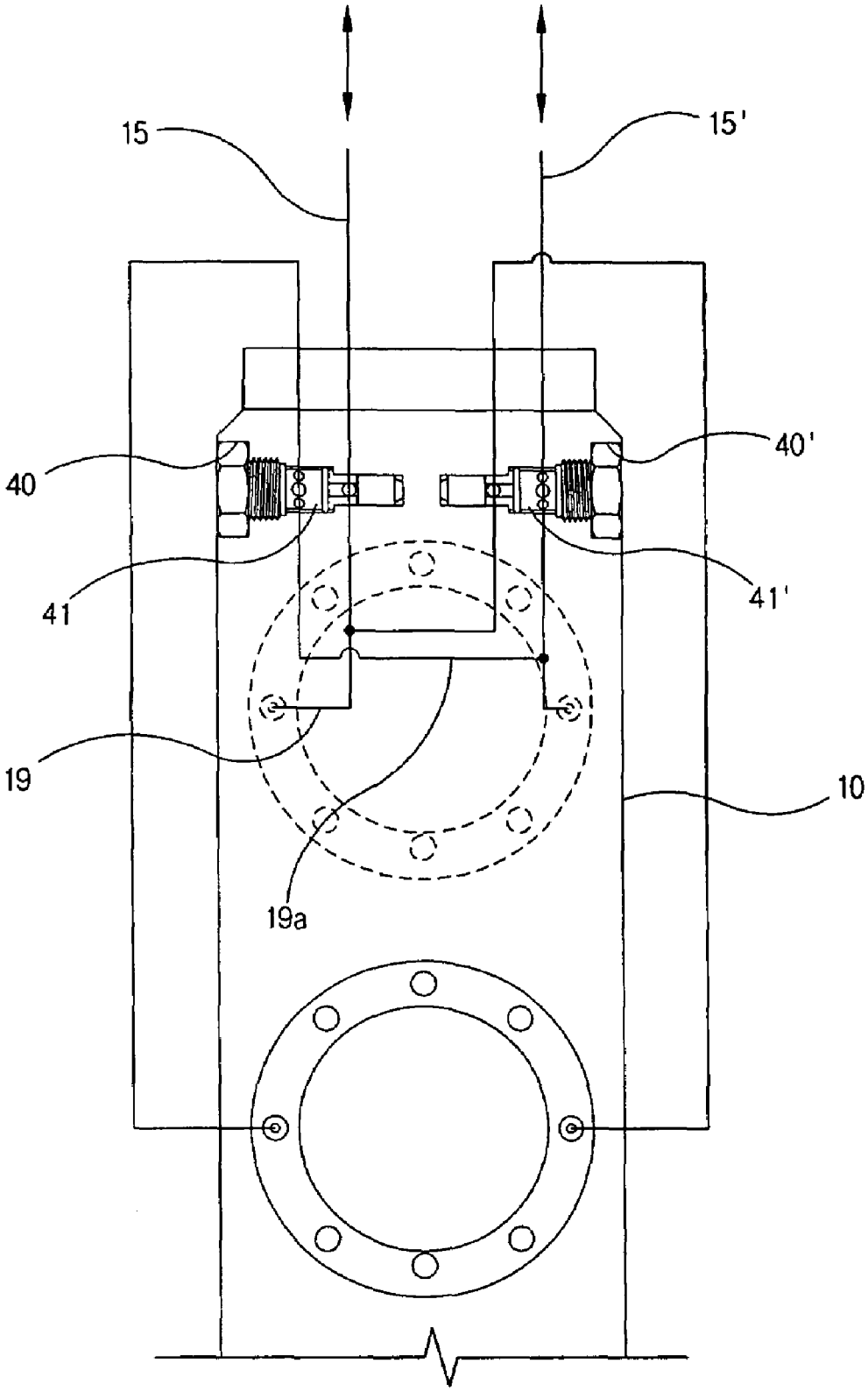
FIG. 9 is a diagram schematically showing another example of channels formed on the excavating screw according to the present invention.

As shown in FIG. 9, the valve mounting seats (40, 40') are formed inside top portion of the extension unit (10), and the check valves (41, 41') are mounted to the valve mounting seats (40, 40'). The double pilot check valves (41, 41') are selectively connected to the built-in fluid passages (15, 15') in the extension unit (10) and the built-in fluid passages (19*a*, 19*b*) in the piston shafts (18). The auxiliary excavating blades (11, 11') are extended and maintained by the pressurized fluid to prevent retraction due to the digging resistance.

The configuration of the extendable excavating screw unit of the present invention will be described in more detail. The extendable excavating screw unit has the excavation column (20), which is inserting the extension rod (30) for performing the deep excavation work. A boss (31) is formed at the top end of this extension rod (30) for mounting the excavating screw unit to a conventional auger crane.

Also, the lower end of the excavation column (20) is mounted to the extension unit (10) having attached the auxiliary excavating blades (11, 11'). A spiral screw (21) is formed on the outer circumference of the excavation column (20) and the extension unit (10) along with the entire length of the excavation column (20).

The excavating screw unit is constructed in such a way that the auxiliary excavating blades (11, 11') are extended and retracted by the pressurized fluid supplied from the fluid system.

For this, the oil inlet and outlet (32, 32') are formed in parallel along with the extension rod apart with constant distance. The oil inlet and outlet (32, 32') are formed at the boss (31) to be connected the hydraulic hose (33) for supplying the oil from the fluid system. Therefore, the hydraulic hose (33) is connected to the oil inlet and outlet (32, 32') to communicate with the oil supplied from the fluid system.

Also, the extension unit (10) is attached to the excavation column (20), and the extension rod (30) is inserted into the excavation column (20), such that it can be extend. Namely, the extension rod (30) allows sliding the total length of the excavating screw unit to adjust by extending outward along with the excavation column (20) or retracting into the excavation column (20). At this time, the built-in hydraulic tubes (14, 14') are inserted to the extension rod (30). The oil inlet and outlet (32, 32') are connected to the built-in hydraulic tubes (14, 14') in the extension rod (30). Further, the built-in hydraulic tube (14, 14') are connected to the flexible hydraulic hoses (51, 51') fixed on the mounting plate (50) to communicate with the built-in fluid passages (15, 15') formed in the extension unit (10).

Figure 5:
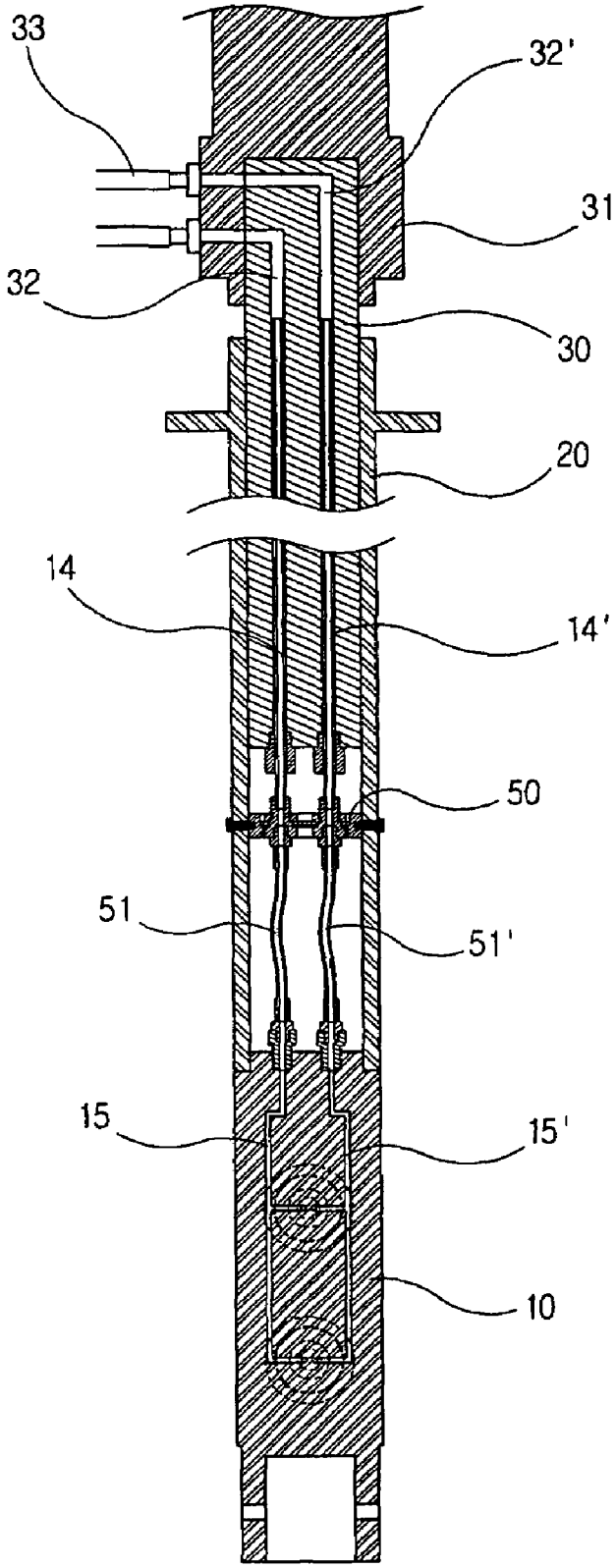
FIG. 5 is a sectional view of the major part showing the oil inflow and discharge passages in the excavating screw according to the present invention.
Figure 6:
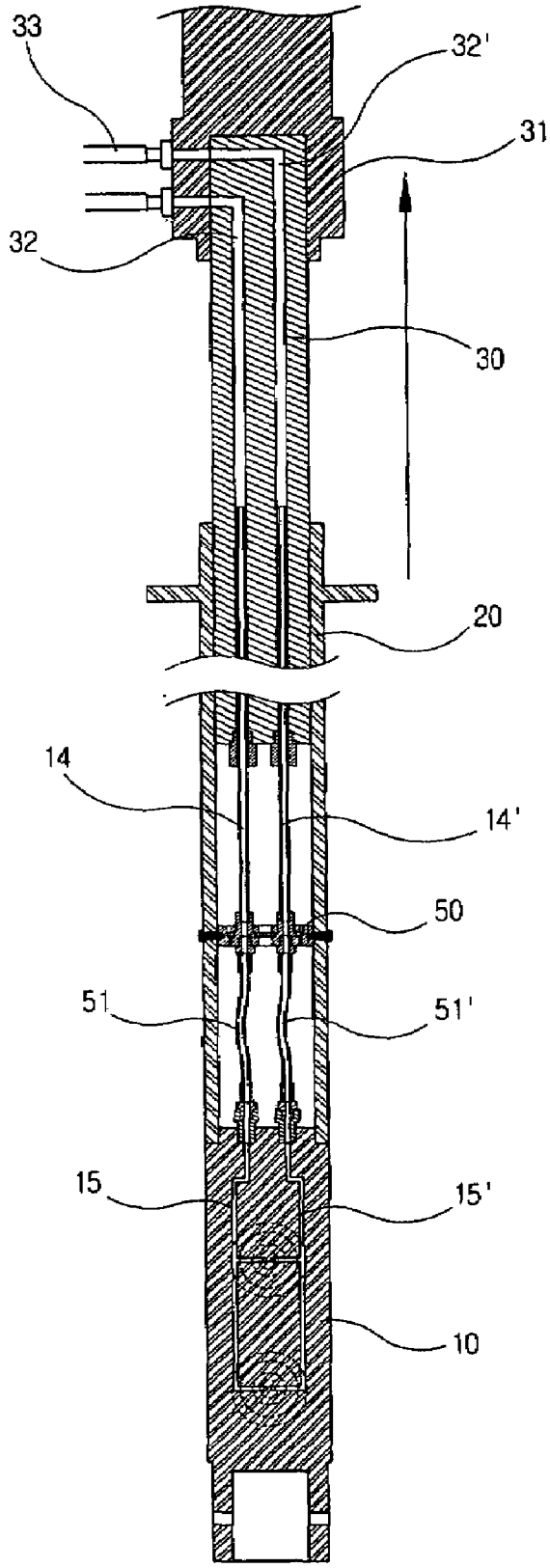
FIG. 6 is a sectional view showing a detail of the channels varied according to the adjusted length of the excavating screw according to the present invention.

Namely, as shown in FIG. 5 and FIG. 6, the built-in hydraulic tube (14, 14') and the flexible hydraulic hoses (51, 51') are located in the excavation column (20) for fluid communication with the oil inlet and outlet (32, 32') during the extension rod (30) extended or retracted from the excavation column (20). The fluid communication between the oil inlet and outlet (32, 32') and built-in fluid passages (15, 15') is maintained through the built-in hydraulic tube (14, 14') and the flexible hydraulic hoses (51, 51').

The auxiliary excavating blades (11, 11') are actuated by the pressurized oil supplied through the built-in fluid passages (15, 15') in the extension unit (10), the flexible hydraulic hoses (51, 51') and the built-in hydraulic tube (14, 14'). The auxiliary excavating blades (11, 11') are operated in such a way that the pressurized oil supplied is supplied to the fluid chambers (17*a*) of the left and right pistons (17), so that the left and right auxiliary excavating blades (11, 11') are extended. Therefore, it is possible for auxiliary excavating blades (11, 11') located at different heights and opposite direction to sliding out or in while the screw is simultaneously advancing or retreating by the supplying of the fluid.

Also, the cylinder mounting holes (12, 12') in the extension unit (10) are formed in opposite directions at different location of heights. Inside the cylinder mounting holes (12, 12'), the tube-shaped cylinders (16, 16') are inserted and fixed to protrude out of the extension unit (10). Into the cylinder 16 is inserted the piston (17) having auxiliary excavating blades (11, 11') at one end.

In particular, the fluid chamber (17*a*) formed a hollow cavity is provided at the center of the piston (17). The piston shaft (18) is inserted into the fluid chamber (17*a*). The other end of the piston shaft (18), an end flange is integrally formed with a plurality of fastening holes for bolts to a flange mounting seats formed at the other ends of the cylinder mounting holes (12, 12') with a plurality of corresponding fastening holes. Therefore, the flange of the piston shaft (18) is firmly fixed to the cylinder mounting holes (12, 12') by a plurality of bolts fastened through these fastening holes. The piston ring (19) is installed at the tip portion of the piston shaft (18) for sealing and contacting with the inner wall of the fluid chamber (17*a*). The built-in fluid passages (19*a*, 19*b*) are formed along the axis of the piston shaft (18), as shown in FIG. 7.

One end of the built-in fluid passages (19*a*, 19*b*) is connected to the built-in fluid passages (15, 15') in the extension unit (10), and the other end of the built-in fluid passages (19*a*, 19*b*) is connected the fluid chamber (17*a*) for fluid communication. Accordingly, the fluid chamber (17*a*) is partitioned by the piston ring (19) for activating the piston (17). When the pressurized fluid is supplied to the fluid chamber (17*a*) through the built-in fluid passages (19*a*, 19*b*) in the piston shaft (18) and the built-in fluid passages (15, 15') in the extension unit (10), the piston (17) is actuated to extending. While the piston (17) is moving in the direction of the arrow, the piston ring (19) is relatively sliding along the inner wall of the fluid chamber (17*a*). Therefore the auxiliary excavating blade (11) is effectively extended to the desired length. At the same time, the fluid in the other vicinity partition of the fluid chamber (17*a*) is discharged through the built-in fluid passages (19*a*, 19*b*) in the piston shaft (18) and the built-in fluid passages (15, 15') in the extension unit (10).

Figure 8:
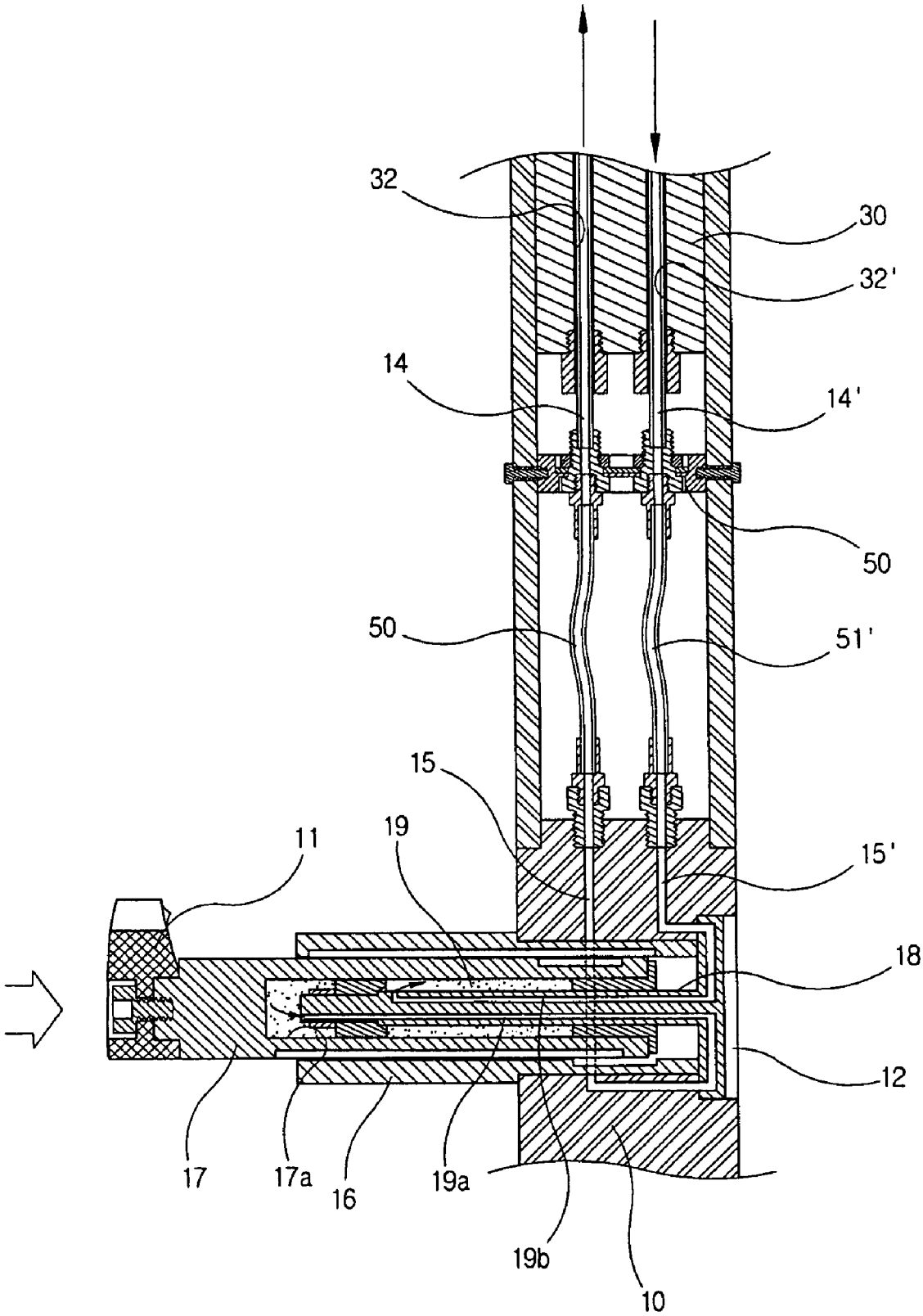
FIG. 8 is a sectional view showing the state in which the auxiliary blades of the excavating screw according to the present invention are retracted by hydraulic pressure.

Conversely, as shown in FIG. 8, when the fluid is supplied to the other side of the fluid chamber (17*a*) partitioned by the piston ring (19) through the built-in fluid passages (19*a*, 19*b*) in the piston shaft (18) and the built-in fluid passages (15, 15') in the extension unit (10), the piston (17) is actuated to retracting. Then, the piston ring (19) is relatively sliding along the inner wall of the fluid chamber (17*a*) by the hydraulic pressure, while the piston (17) is retreating in the direction of the arrow. Therefore, the auxiliary excavating blade (11) is effectively decreasing its length. At the same time, the oil in the neighbored partition of the fluid chamber (17*a*) is discharged through the built-in fluid passages (19*a*, 19*b*) in the piston shaft (18) and the built-in fluid passages (15, 15') in the extension unit (10).

As described above, the fluid supplied or discharged from the oil inlet and outlet (32, 32') flows through the built-in fluid passages (15, 15') in the extension unit (10) and the built-in fluid passages (19*a*, 19*b*) in the piston shaft (18) to actuate the piston (17) extended or retracted.

Therefore, it is possible to conveniently remote-control the extending or retracting of the auxiliary excavating blades (11, 11') by applying the hydraulic pressure. It is also possible to use the excavating screw unit more economically and effectively for deep excavating works as well as excavation for a given depth.

When, the extended auxiliary excavating blades is rotated by the excavating screw unit, the extension rod (30) disposed in the excavation column (20) will be relatively twisted due to the excavating resistance of the extension unit (10). Namely, when the torque applied to the vertical axis of the excavation column (20), the occurrence of twist is different along the assembly of the extension rod (30) and the extension unit (10). If the twist is considerably occurred, the loads would be affected to the built-in hydraulic tube (14, 14'). If the twist is severe, the built-in hydraulic tube (14, 14') will be twisted or damaged to cause a malfunction.

In particular, if the extension rod (30) in the excavation column (20) is expanded down to the maximum, the twist will be increased maximum by the applied load as mentioned above. If the twist goes beyond the allowed limitation, the built-in hydraulic tube (14, 14') will be seriously damaged or deformed to cause the fluid leakages.

To prevent this incident, the mounting plate (50) is installed inside the lower portions of the excavation column (20) for fixedly mounting the lower ends of the built-in hydraulic tube (14, 14'). At the mounting plate (50), a pair of couplings installed to couple the flexible hydraulic hoses (51, 51'). The built-in fluid passages (15, 15') in the extension unit (10) are connected to the other end of the flexible hydraulic hoses (51, 51').

Ultimately, the twist is occurred between the extension unit (10) and the extension rod (30) in the excavation column (20) during the rotation of the excavation screw unit. However, the flexible hydraulic hoses (51, 51') will be effectively absorbed to offset the most twist occurrence. Because the flexible hydraulic hoses (51, 51') are made of relatively soft and strong elastic material, it will absorb a certain level of the twist to prevent the interruption of the fluid supply. Thus, it is possible to provide the fundamentally solution of the aforementioned problem.

Moreover, the mounting plate (50) is located inside of the excavation column (20) for fixedly mounting the built-in hydraulic tube (14, 14'), it will safely and stably protecting the built-in hydraulic tube (14, 14') during the rotation of the excavation screw unit.

The extendable excavating screw unit with the hydraulic auxiliary excavating blades of the present invention can be used a method of continuously supplying the fluid to maintain the extended position when the auxiliary excavating blades (11, 11') are extended and held by the hydraulic pressure. Because the conventional fluid transmission system has a considerable trouble and shock problems when the loads are applied during excavation, it is preferable to use a fluid control technique by adopting the check valves.

As shown in FIG. 9, the valve mounting seats (40, 40') are formed at the lateral side of the extension unit (10) in a opposite direction, and the double pilot check valves (41, 41') are mounted on the valve mounting seats (40, 40'). The double pilot check valves (41, 41') are connected to the built-in fluid passages (15, 15') in the extension unit (10) and the built-in fluid passages in the (19*a*, 19*b*) in the piston shaft (18) for supply the fluid from the inlet and outlet (32, 32').

Namely, when the fluid is supplied from the oil inlet (32) to one side, the pertinent quantity of fluid is allowed to be discharged through the oil outlet (32') of the opposite side. When the fluid supply is ended, the fluid passages opened by the double pilot check valves (41, 41') are shut off to prevent excessively pressurizing the fluid to cause a leaking. Therefore, the auxiliary excavating blades (11, 11') are actuated by the properly pressurized fluid for preventing retracting back due to external force of the digging resistance.

Conversely, when the other side of the fluid is drained to the oil outlet (32'), the one side of the fluid is supplied to open the oil inlet (32). Such a process, the auxiliary excavating blades (11, 11') are extended or retracted from the cylinders (16, 16'). When the retraction is completed, the supply of the fluid is cut-off by the double pilot check valves (41, 41').

Therefore, the auxiliary excavating blades (11, 11') are popped in or out only when the double pilot check valves (41, 41') is opened or closed by the control of the operator.

Since in the extendable excavating screw with hydraulic auxiliary excavating blades the hydraulic pressure continuously acts on the auxiliary excavating blades of the lower extension unit while the excavation length of the extendable excavating screw varies, it is possible to work effectively according to the depth of excavation by using the extendable excavating screw with auxiliary blades operated by hydraulic pressure, so the construction period is shortened and workability is greatly improved.

Although the present invention has been described in detail with reference to its presently preferred embodiment, it will be understood by those skilled in the art that various modifications and equivalents can be made without departing from the spirit and scope of the present invention, as set forth in the appended claims.

What is claimed is:

1. An extendable excavating screw unit having a spiral screw on outer circumference of an excavating shaft is operated by a hydraulic pressure, the excavating screw unit comprising:

an extension unit (10) having a pair of auxiliary excavating blades (11, 11'), cylinder mounting holes (12, 12'), built-in fluid passages in the extension unit (15, 15'), hydraulic cylinders (16) and pistons (17), piston shafts (18) with end flanges and flange mounting seats, an excavation column (20) having a square-shape hollow center, a bottom end of said excavation column (20) mounted on top of said extension unit (10), an extension rod (30) having an outer square-shape to fit into said excavation column (20), a pair of built-in hydraulic tube (14, 14') in the extension rod, the hydraulic passages at top portion of the extension rod (30) bent right angle to form an inlet and outlet (32, 32') for connecting to hydraulic hose (33), wherein said extension rod (30) is inserted into said excavation column (20) for extending or retracting, a pair of valve mounting seats (40, 40') formed transversely inner top portion of the extension unit (10), double pilot check valves (41, 41') mounted on the valve mounting seats (40, 40'), said double pilot check valves (41, 41') are connected to the built-in fluid passages in the extension unit (15, 15') and the fluid passage in the guiding rod (19*a*,19*b*), so that the extended excavating auxiliary blades (11, 11') is maintained by the pressurized fluid for preventing to be retracted by the digging resistance during the excavating operation, and a mounting plate (50) and a pair of flexible hydraulic hoses (51, 51') for fixing and connecting to said pair of built-in hydraulic tube (14, 14') in the extension rod (30) and the built-in fluid passages (15, 15') in the extension unit (10).

2. The extendable excavating screw unit as set forth in claim 1, wherein said pair of cylinder mounting holes (12, 12') is adjacently located up and down in parallel to each other, but drilled through perpendicular to an axis of the extension unit (10), each cylinder (16) is inserted into each cylinder mounting hole (12, 12') from opposite direction until a tip of the cylinder (16) is lined up to the flange mounting seat of the cylinder mounting hole (12, 12'), the piston (17), piston shafts (18) and a piston ring (19) mounted on tip of the piston shaft (18) are inserted into the cylinders (16) through the flange mounting seat of the cylinder mounting holes (12, 12'), a fluid chamber (17*a*) is formed in a central cavity of said piston (17), the end flange is mounted to the flange mounting seat of the mounted cylinder (16), as the piston (17) sliding along the cylinder (16), the piston ring (19) sliding along the inner surface of the fluid chamber (17*a*), and a pressurized fluid communicates through the built-in fluid passages in the extension unit (15, 15') and built-in fluid passages in the guiding rod (19*a*, 19*b*,) into the fluid chamber (17*a*), which is partitioned by said piston ring (19), so that the effective length of the piston (17) is extended or retracted according to the supplied pressurized fluid into the fluid chamber (17*a*).

* * * * *